US006131675A

United States Patent [19]

Anderson

[11] Patent Number: 6,131,675

[45] Date of Patent: Oct. 17, 2000

[54] COMBINATION MILL AND DRILL BIT

[75] Inventor: James W. Anderson, Cypress, Tex.

[73] Assignee: Baker Hughes Incorporated, Houston, Tex.

[21] Appl. No.: 09/149,406

[22] Filed: Sep. 8, 1998

[51] Int. Cl.[7] ..... E21B 29/06

[52] U.S. Cl. ..... 175/268; 175/383; 175/384; 175/412; 166/55.1

[58] Field of Search ..... 175/383, 384, 175/393, 268, 82, 426, 412, 413, 396, 267; 166/55.1

[56] References Cited

U.S. PATENT DOCUMENTS

| | | | |
|---|---|---|---|
| 1,835,108 | 12/1931 | Arthur et al. | 175/263 |
| 1,862,814 | 6/1932 | Wright et al. | 175/397 |
| 1,879,226 | 9/1932 | Heddy | 175/268 |
| 1,909,994 | 5/1933 | Wright | 175/391 |
| 2,071,604 | 2/1937 | Wright et al. | 175/392 |
| 2,256,552 | 9/1941 | Drake | 175/234 |
| 2,498,192 | 2/1950 | Wright | 175/82 |
| 2,595,126 | 4/1952 | Causey | 175/96 |
| 2,819,043 | 1/1958 | Henderson | 255/61 |
| 3,050,122 | 8/1962 | Huitt et al. | 166/55.8 |
| 3,066,749 | 12/1962 | Hildebrandt | 175/317 |
| 3,147,536 | 9/1964 | Lamphere | 407/11 |
| 3,554,305 | 1/1971 | Kammerer, Jr. | 175/268 |
| 3,765,493 | 10/1973 | Rosar et al. | 175/319 |
| 3,908,759 | 9/1975 | Cagle et al. | 166/117 |
| 4,386,669 | 6/1983 | Evans | 175/269 |
| 4,548,282 | 10/1985 | Hurz et al. | 175/61 |
| 4,690,228 | 9/1987 | Voelz et al. | 175/24 |
| 4,776,394 | 10/1988 | Lynde et al. | 166/55.8 |
| 5,012,863 | 5/1991 | Springer | 166/55.7 |
| 5,018,580 | 5/1991 | Skipper | 166/298 |
| 5,027,914 | 7/1991 | Wilson | 175/406 |
| 5,090,480 | 2/1992 | Pittard et al. | 166/298 |
| 5,150,755 | 9/1992 | Cassel et al. | 166/297 |
| 5,201,817 | 4/1993 | Hailey | 175/269 |
| 5,265,675 | 11/1993 | Hearn et al. | 166/297 |
| 5,431,220 | 7/1995 | Lennon et al. | 166/55.7 |
| 5,560,440 | 10/1996 | Tibbitts | 175/384 |
| 5,826,651 | 10/1998 | Lee et al. | 166/117.6 |
| 5,931,239 | 8/1999 | Schuh | 175/61 |
| 5,979,571 | 11/1999 | Scott et al. | 175/61 |

FOREIGN PATENT DOCUMENTS

| | | |
|---|---|---|
| 2 323 112 | 4/1998 | United Kingdom . |
| WO 98/34007 | 8/1998 | WIPO . |

*Primary Examiner*—Eileen D. Lillis
*Assistant Examiner*—John Kreck
*Attorney, Agent, or Firm*—Gerald W. Spinks

[57] ABSTRACT

A combination milling and drilling bit which can be converted from a first type of cutting operation to a second type of cutting operation by hydraulically moving a plurality of movable blades to extend beyond a plurality of fixed blades. The fixed blades are dressed with cutting inserts suitable for the first type of cutting operation, while the movable blades are dressed with cutting inserts suitable for the second type of cutting operation.

22 Claims, 2 Drawing Sheets

COMBINATION MILL AND DRILL BIT

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of tools used for drilling oil and gas wells. Specifically, this invention applies to the drilling of a new well bore which branches off from an existing well bore which has been drilled and cased. This invention also applies to drilling through a cemented hole, followed by milling out a bridge plug or float equipment.

2. Background Information

It very often occurs that after a well bore has been drilled and the casing installed, a need arises to drill a new well bore off to the side, or at an angle, from the original well bore. The new well bore may be a lateral bore extending outwardly from the original vertical well bore. The process of starting a new well bore from the existing bore is often called "kicking off" from the original bore. Kicking off from an existing well bore in which metal casing has been installed requires that the casing first be penetrated at the desired depth.

Typically, a section mill or window mill is used to penetrate the metal casing, then the window mill and the drill string are withdrawn from the well bore. Following the milling of the window, a drill bit is mounted on the drill string, run back into the well, and used to drill the lateral well bore. Tripping in and out of the well bore delays the drilling process and makes the well more expensive to complete. The reason for using two different tools in spite of this is that the window mill must penetrate the metal casing, while the drill bit must penetrate the subterranean formation, which often contains highly abrasive constituents.

Similarly, when it is necessary to drill through a cemented hole, then mill away downhole metal items, two trips must be made. First, a drill bit is attached to the drill string, run into the hole, and used to drill through the cement. The drill string is then tripped out, the drill bit removed, and a milling tool is attached. The drill string is then run into the hole to mill away the bridge plug or other metal member.

Milling of metal requires a type of cutting insert which is formed of a material hard enough to cut the metal but durable enough to avoid excessive breakage or chemical deterioration of the insert. If the insert crumbles or deteriorates excessively, the insert will lose the sharp leading edge which is considered most desirable for the effective milling of metal. Both hardness and durability are important. It has been found that a material such as tungsten carbide is sufficiently hard to mill typical casing steel, while it is structurally durable and chemically resistant to exposure to the casing steel, allowing the insert to wear away gradually rather than crumbling, maintaining its sharp leading edge.

Drilling through a rock formation or cement requires a type of cutting insert which is formed of a material as hard as possible, to allow the insert to gouge or scrape chunks out of the rock or cement without excessive wear or abrasion of the insert. This permits the drilling operator to drill greater lengths of bore hole with a single drill bit, limiting the number of trips into and out of the well. It has been found that a material such as polycrystalline diamond is an excellent choice for drilling through a rock formation or cement, because of its extreme hardness and abrasion resistance.

Tungsten carbide is not as good as polycrystalline diamond for drilling through rock or cement, because the diamond is harder and will therefore last longer, limiting the number of trips required. Polycrystalline diamond is not as good for milling through metal casing as tungsten carbide, because the diamond is not as structurally durable, allowing it to crumble more readily and destroy the sharp leading edge. Further, polycrystalline diamond has a tendency to deteriorate through a chemical reaction with the casing steel. There is a chemical reaction between the iron in the casing and the diamond body, which occurs when steel is machined with a diamond insert. As a result of this chemical reaction, the carbon in the diamond turns to graphite, and the cutting edge of the diamond body deteriorates rapidly. This prevents the effective machining of the steel casing with diamond. Therefore, tungsten carbide is the better choice for milling through the metal casing, and polycrystalline diamond is the better choice for drilling through rock or cement.

Unfortunately, in both of these types of operations, use of each type of cutting insert in its best application requires that a first tool be used to perform a first operation, and that a second tool be used to perform a second operation. This means that two trips are required for the kickoff and drilling operation, or for the cement drilling and bridge plug milling operation. It would be very desirable to be able to perform a single trip operation, thereby eliminating at least one trip into and out of the bore hole.

BRIEF SUMMARY OF THE INVENTION

The present invention is a combination milling and drilling tool for use in performing a single trip milling-then-drilling operation. Similarly, a tool according to the present invention can be used in performing a single trip drilling-then-milling operation. The tool has a plurality of milling inserts suitable for metal milling, for performing the kickoff or milling operation, and a plurality of drilling inserts suitable for rock drilling, for drilling through the subterranean formation or cement. The milling and drilling types of cutting inserts are positioned relative to each other on the tool so that only the milling inserts contact the metal casing during the milling operation, and the drilling inserts are exposed to contact with the subterranean formation or cement, during the drilling operation. The specific embodiment discussed here will first deploy the milling inserts, followed by deployment of the drilling inserts. It is understood that, where drilling is required first, and milling second, the mounting locations of the two types of cutting inserts are simply swapped.

The milling insert can be formed of a relatively more durable material than the drilling insert, because it will need to maintain its sharp leading edge during metal milling. The drilling insert can be formed of a relatively harder material than the milling insert, because it will need to resist wear and abrasion during rock drilling. The milling insert can be formed of tungsten carbide, $Al_2O_3$, TiC, TiCN, or TiN, or another material hard enough to mill casing steel but relatively durable and chemically nonreactive with the steel. The drilling insert can be formed of polycrystalline diamond or another material of similar hardness, to facilitate drilling through a rock formation or cement.

The tool of the present invention employs a first cutting structure which is mounted in a fixed location on the tool body, and a second cutting structure which is movably mounted on the tool body. The second cutting structure is initially retained in a withdrawn position within the tool body, by retaining elements such as shear pins. A plurality of cutting inserts of a first type, suitable for the first phase of the operation, are mounted on the fixed cutting structure. A plurality of cutting inserts of a second type, suitable for the second phase of the operation, are mounted on the movable cutting structure. An actuator plug within the tool body is hydraulically moved from a first position to a second position, to move the movable cutting structure from its initial, withdrawn, position to a second, extended position, so that the second type of cutting inserts are moved downwardly and outwardly to come into play. A capture element retains the movable cutting structure in its deployed position.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
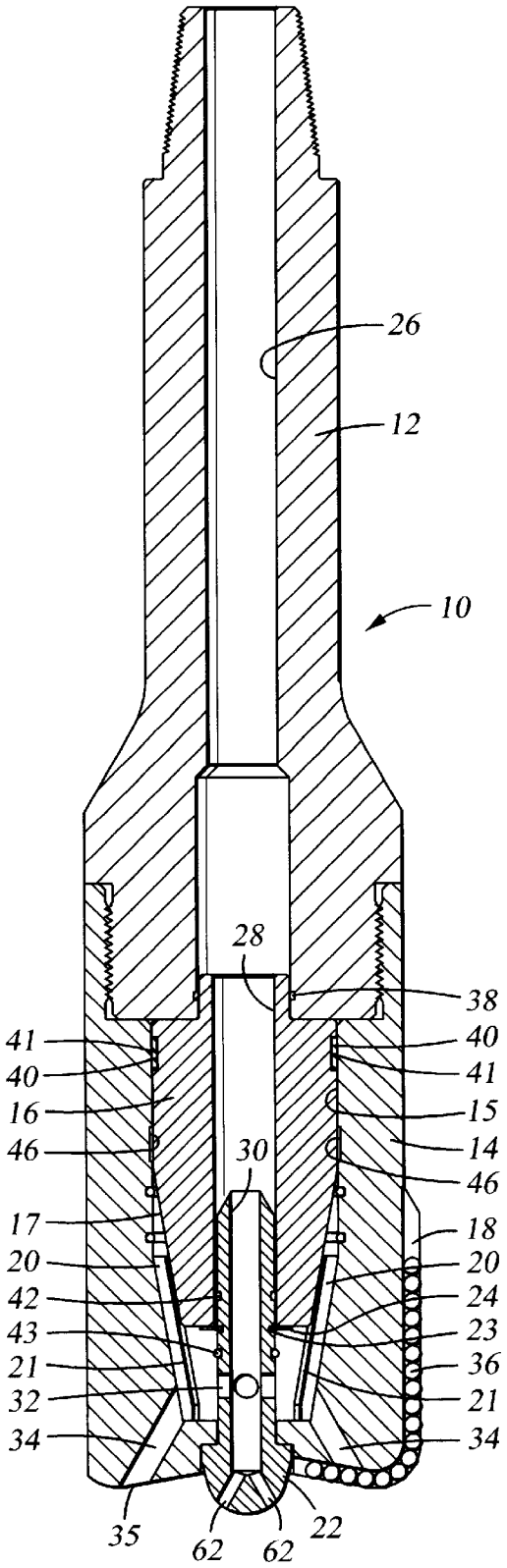
FIG. 1 is a longitudinal section view of the tool of the present invention, showing the movable cutting structure withdrawn into the tool body.

As shown in FIG. 1, the combination milling tool and drill bit 10 of the present invention includes an upper body 12, a lower body 14, a hydraulic actuator plug 16, a plurality of fixed cutting blades 18, and a plurality of movable cutting blades 20. The upper body 12 can be threadedly attached at its upper end to a drill string. The lower body 14 is threaded onto the lower end of the upper body 12. The actuator plug 16 is slidably retained within a central cavity 15 in the lower body 14, with the actuator plug 16 being shown in its upper position in FIG. 1. The actuator plug 16 has a lower conical surface 17, which is angled with respect to the longitudinal axis of the tool 10.

The plurality of fixed cutting blades 18 are mounted around the periphery of the lower body 14, with each fixed blade 18 having a substantially vertical leading face upon which a first group of cutting inserts 36 are mounted. Where the tool will be used first for milling and then for drilling, the first group of cutting inserts 36 are milling inserts. The milling inserts can be formed of tungsten carbide, $Al_2O_3$, TiC, TiCN, or TiN, or another material hard enough to mill casing steel but relatively durable and chemically nonreactive with the steel. The plurality of movable blades 20 are shown in their initial, withdrawn, position, within slots in the lower body 14. Each movable blade 20 is retained in this initial position by a releasable retaining element such as a shear pin 56, shown in FIG. 2. Each movable blade 20 also has an inner edge 21 which is angled with respect to the longitudinal axis of the tool 10. A fixed end plug 22 is welded or threaded into the lower end of the lower body 14.

The slidable actuator plug 16 is held in its initial, upper, position by a shearable ring 24, which is held in its position by a circumferential groove 23 in the outer surface of the end plug 22. A longitudinal bore 26 in the upper body 12 is in fluid flow communication with a longitudinal bore 28 in the actuator plug 16, and with a longitudinal bore 30 in the end plug 22. One or more fluid ports 32 lead from the longitudinal bore 30 in the end plug 22 to the central cavity 15 within the lower body 14. A first plurality of fluid passageways 34 lead from the central cavity 15 to a first plurality of fluid ports 35 on the lower end face of the tool 10, just in front of the fixed cutting blades 18. When the actuator plug 16 is in its upper position shown in FIG. 1, the first plurality of fluid passageways 34 are uncovered, allowing fluid to flow from the work string via the longitudinal bores 26, 28, 30 and the central cavity 15, exiting the first plurality of fluid ports 35 to facilitate the cutting action of the fixed blades 18. A plurality of central fluid passageways 62 can be provided to conduct fluid to the central portion of the lower end of the tool 10, to further facilitate the cutting action of the fixed blades 18.

An upper body seal 38 seals between the outer surface of the upper end of the slidable actuator plug 16 and the upper body 12, when the actuator plug 16 is retained in the upper position. In this position, a capture ring 40 is held entirely within an inner capture ring groove 41 on the outer surface of the actuator plug 16. Upper and lower end plug seals 42, 43 are provided in circumferential grooves on the outer surface of the end plug 22. The upper end plug seal 42 seals between the end plug 22 and the longitudinal bore 28 of the actuator plug 16, when the actuator plug 16 is in the upper position. An outer capture ring groove 46 is provided in the central cavity 15 of the lower body 14.

Figure 2:
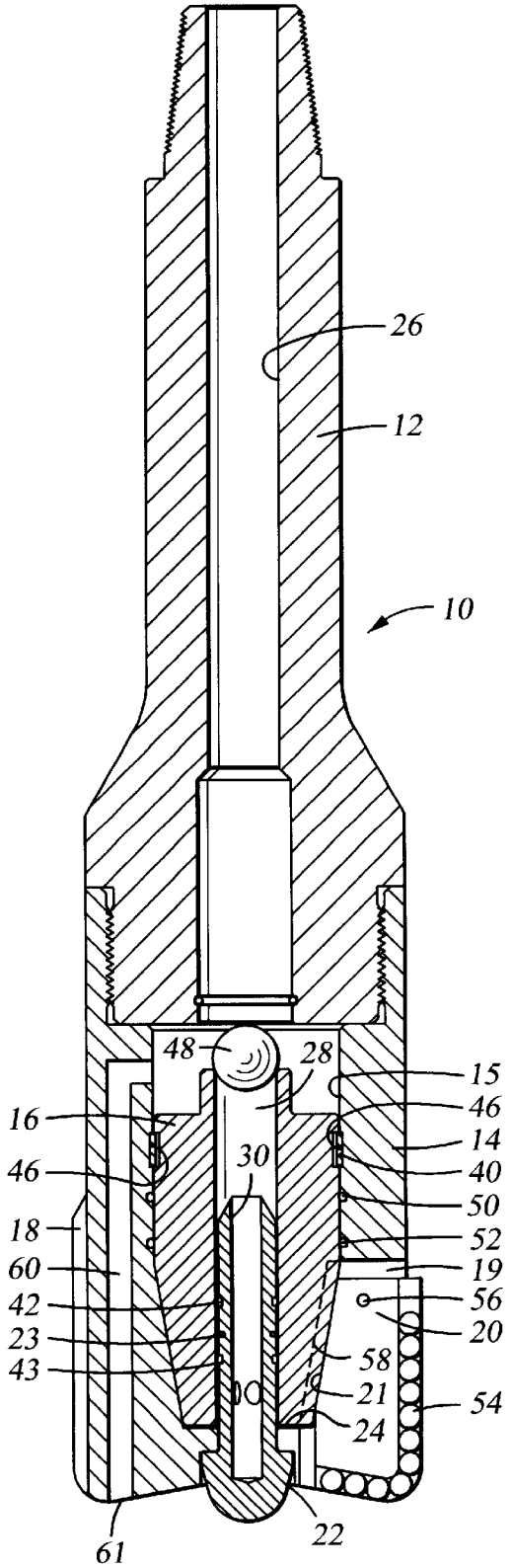
FIG. 2 is a longitudinal section view of the tool shown in FIG. 1, showing the movable cutting structure extended to its deployed position.

As seen in FIG. 2, a ball 48 can be dropped through the drill string to pass through the longitudinal bore 26 of the upper body 12, and come to rest at the upper end of the actuator plug 16, blocking the longitudinal bore 28 of the actuator plug 16. Continued pumping of fluid through the drill string will build up pressure on the actuator plug 16 until it shears the shear ring 24 and moves downwardly to the lower position shown in FIG. 2. When the tool is used with a downhole mud motor, the drilling fluid pressure can be increased to a point which will shear the shear ring 24, without the necessity for dropping a ball. In either case, as the actuator plug 16 moves downwardly, its conical lower surface 17 abuts and exerts downward and outward force on the angled inner edges 21 of the movable blades 20. This shears the shear pins 56 holding the movable blades 20, and moves the movable blades 20 downwardly and outwardly in their respective slots 19. This downward and outward motion can be either purely translational motion as shown in FIGS. 1 and 2, or it can have a rotational component. The movable blades 20 can be prevented from falling out of their respective slots 19 by means such as abutting shoulders (not shown) on the blades 20 and slots 19. In this lower position of the actuator plug 16, the capture ring 40 snaps partially into the outer capture ring groove 46 in the lower body 14, and remains partially in the inner capture ring groove 41 in the actuator plug 16, to hold the actuator plug 16 permanently in the lower position. Upper and lower actuator plug seals 50, 52 seal between the outer surface of the actuator plug 16 and the central cavity 15 of the lower body 14, when the actuator plug 16 is in the lower position.

As seen in FIG. 2, each movable blade 20 has a substantially vertical leading face upon which a second group of cutting inserts 54 are mounted. Where the tool will be used first for milling and then for drilling, the second group of cutting inserts 54 are drilling inserts. The drilling inserts can be formed of polycrystalline diamond or another material of similar hardness, to facilitate drilling through a rock formation or cement. The dashed line 58 in FIG. 2 shows the position which was occupied by the inner edge 21 of the movable blade 20, when it was in its initial, withdrawn, position. By comparison of the dashed line 58 with the edge 21 in FIG. 2, it can be seen that the movable blade 20 has moved downwardly and outwardly to position the second group of cutting inserts 54 downwardly and outwardly beyond the first group of cutting inserts 36. This deploys the second group of cutting inserts 54 to commence their designed cutting action. When the tool 10 is designed for a milling-then-drilling application, this downward and outward motion of the movable blades 20 converts the tool 10 from a milling tool to a drill bit.

A second plurality of fluid passageways 60 lead from the central cavity 15 to a second plurality of fluid ports 61 on the lower end face of the tool 10, just in front of the movable cutting blades 20. When the actuator plug 16 moves to its lower position shown in FIG. 2, the second plurality of fluid passageways 60 are uncovered, allowing fluid to flow from the work string via the longitudinal bore 26 and the central cavity 15, exiting the ports 61 to facilitate the cutting action of the movable blades 20. Simultaneously, the actuator plug 16 blocks flow through the first plurality of fluid passageways 34.

Figure 3:
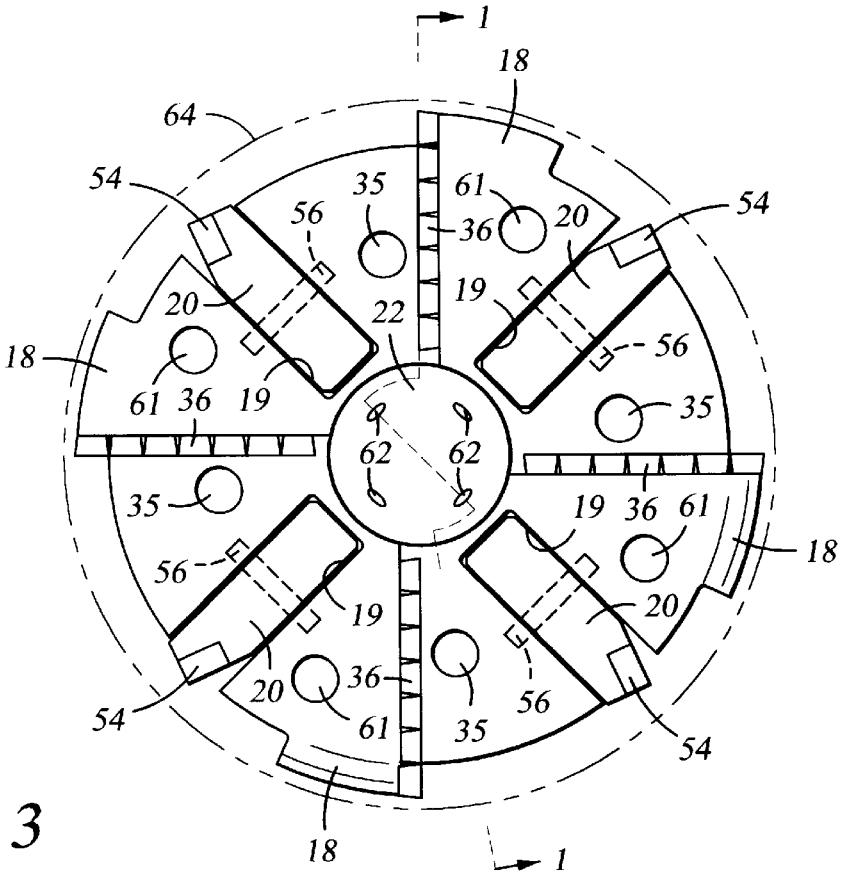
FIG. 3 is an end view of the tool of the present invention, showing the configuration in FIG. 1.
Figure 4:
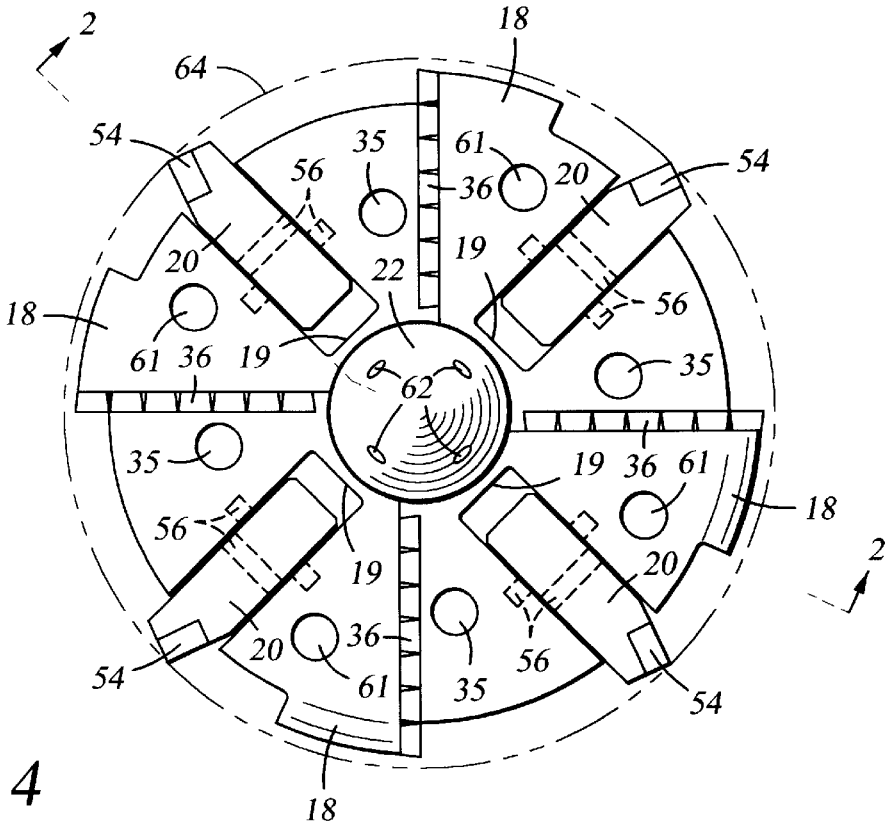
FIG. 4 is an end view of the tool of the present invention, showing the configuration in FIG. 2.

FIGS. 3 and 4 illustrate the outward movement of the movable blades 20. FIG. 3 shows the movable blades 20 in their initial, withdrawn, position in their slots 19, corresponding to the configuration of the tool 10 shown in FIG. 1. It can be seen that the first group of cutting inserts 36 extend farther outwardly than the second group of cutting inserts 54. The dashed circle 64 represents the desired diameter of the borehole to eventually be drilled through the formation, after deployment of the second group of cutting inserts 54. FIG. 4 shows the movable blades 54 in their second, extended, position in their respective slots 19, corresponding to the configuration of the tool 10 shown in FIG. 2. It can be seen that the second group of cutting inserts 54 have extended beyond the first group of cutting inserts 36, to create the desired borehole diameter represented by the dashed circle 64.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A combination tool for multiple cutting operations downhole in a well bore, said tool comprising:

a tool body;

at least one fixed cutting structure mounted to said tool body, said at least one fixed cutting structure having a first group of cutting inserts mounted thereon;

at least one movable cutting structure mounted to said tool body, said at least one movable cutting structure having a second group of cutting inserts mounted thereon;

an actuator for selectively moving at least one movable cutting structure from a first position relative to said tool body in which said first group of cutting inserts define the cutting profile of the tool by extending beyond said second group, to a second position relative to said tool body in which said second group of cutting inserts define the cutting profile of the tool by extending beyond said first group; and a releasable retaining element for releasably retaining said movable cutting structure in said first position relative to said tool body.

2. The combination tool recited in claim 1, wherein said releasable retaining element releasably attaches said movable cutting structure directly to said tool body in said first position.

3. The combination tool recited in claim 1, wherein said releasable retaining element releasably attaches said actuator directly to said tool body when said movable cutting structure is in said first position.

4. The combination tool recited in claim 1, wherein said first group of cutting inserts and said second group of cutting inserts differ in at least one characteristic selected from the group of durability, hardness, size and shape.

5. The combination tool recited in claim 1, further comprising a capture element for capturing and permanently retaining said movable cutting structure in said second position.

6. The combination tool recited in claim 5, wherein said capture element captures and permanently attaches said actuator to said tool body when said movable cutting structure is in said second position.

7. A combination tool for multiple cutting operations downhole in a well bore, said tool comprising:

a tool body;

at least one fixed cutting structure mounted to said tool body, said at least one fixed cutting structure having a first group of cutting inserts mounted thereon;

at least one movable cutting structure mounted to said tool body, said at least one movable cutting structure having a second group of cutting inserts mounted thereon;

an actuator for selectively moving said at least one movable cutting structure from a first position in which said first group of cutting inserts extend farther from said tool body than said second group, to a second position in which said second group of cutting inserts extend farther from said tool body than said first group; and a releasable retaining element for releasably retaining said movable cutting structure in said first position;

wherein said releasable retaining element releasably attaches said movable cutting structure directly to said tool body in said first position; and wherein said releasable retaining element comprises a shear pin.

8. A combination tool for multiple cutting operations downhole in a well bore, said tool comprising:

a tool body;

at least one fixed cutting structure mounted to said tool body, said at least one fixed cutting structure having a first group of cutting inserts mounted thereon;

at least one movable cutting structure mounted to said tool body, said at least one movable cutting structure having a second group of cutting inserts mounted thereon;

an actuator for selectively moving said at least one movable cutting structure from a first position in which said first group of cutting inserts extend farther from said tool body than said second group, to a second position in which said second group of cutting inserts extend farther from said tool body than said first group; and a releasable retaining element for releasably retaining said movable cutting structure in said first position;

wherein said releasable retaining element releasably attaches said actuator directly to said tool body when said movable cutting structure is in said first position; and wherein said releasable retaining element comprises a shear ring.

9. A combination tool for multiple cutting operations downhole in a well bore, said tool comprising:

a tool body;

at least one fixed cutting structure mounted to said tool body, said at least one fixed cutting structure having a first group of cutting inserts mounted thereon;

at least one movable cutting structure mounted to said tool body, said at least one movable cutting structure having a second group of cutting inserts mounted thereon;

an actuator for selectively moving said at least one movable cutting structure from a first position in which said first group of cutting inserts extend farther from said tool body than said second group, to a second position in which said second group of cutting inserts extend farther from said tool body than said first group;

a releasable retaining element for releasably retaining said movable cutting structure in said first position; and a capture element for capturing and permanently retaining said movable cutting structure in said second position;

wherein said capture element captures and permanently attaches said actuator to said tool body when said movable cutting structure is in said second position; and wherein said capture element comprises a retainer ring.

10. A combination tool for multiple cutting operations downhole in a well bore, said tool comprising:

a tool body;

at least one fixed cutting structure mounted to said tool body, said at least one fixed cutting structure having a first group of cutting inserts mounted thereon;

at least one movable cutting structure mounted to said tool body, said at least one movable cutting structure having a second group of cutting inserts mounted thereon;

an actuator for selectively moving said at least one movable cutting structure from a first position in which said first group of cutting inserts extend farther from said tool body than said second group, to a second position in which said second group of cutting inserts extend farther from said tool body than said first group; and a releasable retaining element for releasably retaining said movable cutting structure in said first position;

wherein said movable cutting structure comprises at least one blade slidable within a slot in said tool body; and wherein said actuator comprises a selectively slidable plug in said tool body, said slidable plug being positioned to contact said at least one slidable blade and move said at least one slidable blade from said first position to said second position.

11. The combination tool recited in claim 10, wherein said selectively slidable plug moves said slidable blade in translational motion from said first position to said second position.

12. The combination tool recited in claim 11, wherein said slidable plug comprises a surface angled relative to the longitudinal axis of said tool body, said angled surface being positioned to contact said at least one slidable blade and move said at least one slidable blade outwardly and downwardly from said first position to said second position.

13. A combination tool for multiple cutting operations downhole in a well bore, said tool comprising:

a tool body;

at least one fixed cutting structure mounted to said tool body, said at least one fixed cutting structure having a first group of cutting inserts mounted thereon;

at least one movable cutting structure mounted to said tool body, said at least one movable cutting structure having a second group of cutting inserts mounted thereon;

an actuator for selectively moving said at least one movable cutting structure from a first position in which said first group of cutting inserts extend farther from said tool body than said second group, to a second position in which said second group of cutting inserts extend farther from said tool body than said first group;

a releasable retaining element for releasably retaining said movable cutting structure in said first position;

a first fluid passageway directing fluid to an area in front of said fixed cutting structure; and a second fluid passageway directing fluid to an area in front of said movable cutting structure;

wherein said first fluid passageway receives fluid flow when said movable cutting structure is in said first position, and said second fluid passageway receives fluid flow when said movable cutting structure is in said second position.

14. The combination tool recited in claim 13, wherein:

said actuator blocks said second fluid passageway when said movable cutting structure is in said first position; and said actuator blocks said first fluid passageway when said movable cutting structure is in said second position.

15. A combination tool for milling and drilling downhole in a well bore, said tool comprising:

a tool body;

at least one milling structure fixedly mounted to said tool body, said at least one milling structure having a plurality of milling inserts mounted thereon;

at least one drilling structure movably mounted to said tool body, said at least one drilling structure having a plurality of drilling inserts mounted thereon; and a hydraulic actuator for selectively moving said at least one drilling structure from a first position relative to said tool body in which said milling inserts extend farther from said tool body than said drilling inserts, to a second position relative to said tool body in which said drilling inserts extend farther from said tool body than said milling inserts;

a releasable retaining element for releasably retaining said drilling structure in said first position relative to said tool body; and a capture element for capturing and permanently retaining said drilling structure in said second position relative to said tool body.

16. A combination tool for milling and drilling downhole in a well bore, said tool comprising:

a tool body;

at least one milling structure fixedly mounted to said tool body, said at least one milling structure having a plurality of milling inserts mounted thereon;

at least one drilling structure movably mounted to said tool body, said at least one drilling structure having a plurality of drilling inserts mounted thereon; and a hydraulic actuator for selectively moving said at least one drilling structure from a first position in which said milling inserts extend farther from said tool body than said drilling inserts, to a second position in which said drilling inserts extend farther from said tool body than said milling inserts;

a releasable retaining element for releasably retaining said drilling structure in said first position; and a capture element for capturing and permanently retaining said drilling structure in said second position;

wherein said drilling structure comprises at least one blade slidable within a slot in said tool body; and wherein said hydraulic actuator comprises a selectively slidable plug in said tool body, said slidable plug being positioned to contact said at least one slidable blade and move said at least one slidable blade from said first position to said second position.

17. The combination tool recited in claim 16, wherein said slidable plug moves said slidable blade in translational motion from said first position to said second position.

18. The combination tool recited in claim 17, wherein said slidable plug comprises a surface angled relative to the longitudinal axis of said tool body, said angled surface being positioned to contact said at least one slidable blade and move said at least one slidable blade outwardly and downwardly from said first position to said second position.

19. A combination tool for milling and drilling downhole in a well bore, said tool comprising:

a tool body;

at least one milling structure fixedly mounted to said tool body, said at least one milling structure having a plurality of milling inserts mounted thereon;

at least one drilling structure movably mounted to said tool body, said at least one drilling structure having a plurality of drilling inserts mounted thereon; and a hydraulic actuator for selectively moving said at least one drilling structure from a first position in which said milling inserts extend farther from said tool body than said drilling inserts, to a second position in which said drilling inserts extend farther from said tool body than said milling inserts;

a releasable retaining element for releasably retaining said drilling structure in said first position;

a capture element for capturing and permanently retaining said drilling structure in said second position;

a first fluid passageway directing fluid to an area in front of said milling structure; and a second fluid passageway directing fluid to an area in front of said drilling structure;

wherein said first fluid passageway receives fluid flow when said drilling structure is in said first position, and said second fluid passageway receives fluid flow when said drilling structure is in said second position.

20. The combination tool recited in claim 19, wherein:

said hydraulic actuator blocks said second fluid passageway when said drilling structure is in said first position; and said hydraulic actuator blocks said first fluid passageway when said drilling structure is in said second position.

21. A combination tool for milling and drilling downhole in a well bore, said tool comprising:

a tool body;

at least one slot in said tool body;

a fluid supply passageway in said tool body;

at least one milling structure fixedly mounted to said tool body, said at least one milling structure having a plurality of milling inserts mounted thereon;

at least one drilling blade slidably mounted in said at least one slot in said tool body, said at least one drilling blade having a plurality of drilling inserts mounted thereon;

a hydraulically actuatable slidable plug within said fluid supply passageway of said tool body;

a conical surface on said slidable plug, said conical surface being positioned to contact said at least one slidable drilling blade and move said at least one slidable drilling blade outwardly and downwardly in translational motion, from a first position in which said milling inserts extend farther from said tool body than said drilling inserts, to a second position in which said drilling inserts extend farther from said tool body than said milling inserts;

a milling fluid outlet passageway in said tool body, said milling fluid outlet passageway being positioned to direct fluid from said fluid supply passageway to an area in front of said milling structure;

a drilling fluid outlet passageway in said tool body, said drilling fluid outlet passageway being positioned to direct fluid from said fluid supply passageway to an area in front of said drilling blade;

a first releasable retaining element for releasably attaching said slidable drilling blade to said tool body in said first position;

a second releasable retaining element for releasably attaching said slidable plug to said tool body, with said slidable drilling blade in said first position;

a capture element for capturing and permanently retaining said slidable plug to said tool body, with said slidable drilling blade in said second position;

wherein said slidable plug allows flow to said milling fluid passageway when said slidable drilling blade is in said first position, and said slidable plug allows flow to said drilling fluid passageway when said slidable drilling blade is in said second position.

22. The combination tool recited in claim 21, wherein said slidable plug blocks flow to said drilling fluid passageway when said slidable drilling blade is in said first position, and blocks flow to said milling fluid passageway when said slidable drilling blade is in said second position.

* * * * *